US012569094B1

(12) United States Patent
Gonterman

(10) Patent No.: US 12,569,094 B1
(45) Date of Patent: Mar. 10, 2026

(54) FLUSHABLE WIPE MITT FOR USE IN TOILET TRAINING

(71) Applicant: Stephen D. Gonterman, Gulf Breeze, FL (US)

(72) Inventor: Stephen D. Gonterman, Gulf Breeze, FL (US)

( * ) Notice: Subject to any disclaimer, the term of this patent is extended or adjusted under 35 U.S.C. 154(b) by 407 days.

(21) Appl. No.: 18/101,307

(22) Filed: Jan. 25, 2023

Related U.S. Application Data

(60) Provisional application No. 63/302,650, filed on Jan. 25, 2022.

(51) Int. Cl.
*A47K 7/02* (2006.01)
*A47K 7/08* (2006.01)

(52) U.S. Cl.
CPC . *A47K 7/02* (2013.01); *A47K 7/08* (2013.01)

(58) Field of Classification Search
CPC .. A47K 7/08; A47K 7/02; A41D 19/00–0096; A61F 2013/49066
See application file for complete search history.

(56) References Cited

U.S. PATENT DOCUMENTS 2,234,670 A 3/1941 Fiandach
3,183,543 A 5/1965 Worcester
3,638,789 A 2/1972 Tuszewski
5,020,160 A * 6/1991 Cano ..... A41D 19/0093 2/161.7
5,542,566 A 8/1996 Glaug
5,616,201 A 4/1997 Finch
5,806,099 A * 9/1998 Grinberg ..... A41D 19/0068 2/161.6
5,987,645 A 11/1999 Teaster
6,145,155 A * 11/2000 James ..... A47L 13/19 15/118
6,146,365 A * 11/2000 Nguyen ..... B65D 33/002 206/390
6,687,911 B2 * 2/2004 Fitz ..... A61F 13/2051 2/21
7,681,250 B2 3/2010 Friedstrom
D758,020 S 5/2016 Santini
10,149,591 B2 * 12/2018 Hagen ..... A41D 19/01
2008/0172767 A1 * 7/2008 Friedstrom ..... A47K 7/02 2/16
2009/0188018 A1 7/2009 Bates

* cited by examiner

*Primary Examiner* — Catharine L Anderson
*Assistant Examiner* — Meagan Ngo
(74) *Attorney, Agent, or Firm* — Mark D. Bowen, Esq.; Malin Haley DiMaggio & Bowen, P.A.

(57) ABSTRACT

A flushable sanitary wipe mitt includes an open end, a closed end, opposing first and second sides, and a peripheral edge connecting the first and second sides. Each of the first and second sides further include a tab projecting from the open end and a pair of perforation lines extending from the tab toward the closed end. The tab and perforation lines function to allow the user to peel back a generally V-shaped portion of one side to facilitate easy removal and disposal of the mitt from the user's hand. The toilet paper wipe mitt provides young children with an easy to use, disposable, sanitary toilet training tool that assists children in learning to properly and thoroughly clean themselves without soiling their hand after using the toilet.

10 Claims, 2 Drawing Sheets

FLUSHABLE WIPE MITT FOR USE IN TOILET TRAINING

CROSS REFERENCE TO RELATED APPLICATIONS

This application claims the benefit of provisional U.S. Patent Application Ser. No. 63/302,650, filed on Jan. 25, 2022.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to toilet training for toddlers, and more particularly to flushable sanitary wipe mitts to be worn on a toddler's hand while wiping themselves after going to the bathroom.

2. Description of Related Art

Toilet training (a/k/a Potty Training) is an important part of childhood development and an important milestone for both children and parents. It can often be an exhausting and frustrating process, but with patience and consistency, it can be a successful and rewarding experience. In a basic sense, toilet training is a developmental process through which small children learn the task of properly going to the bathroom and cleaning themselves. Mastering toilet training is a milestone in child development. A number of toilet training devices have been developed to assist in the toilet training. Such devices include child sized toilet seat attachments, small potty chairs, and footstools.

One of the more delicate tasks associated with toilet training involves having the toddler learn to properly wipe himself/herself after using the toilet, especially after a bowel movement. In this regard, the primary goal of parents and caregivers is to have the child become independent in cleaning themselves after going to the toilet. Typically, the child is introduced and instructed in the use of conventional toilet paper. Mastering the use of conventional toilet paper, however, has proven difficult for toddlers and young children. One reason that toddlers have difficulty learning how to clean themselves with conventional toilet paper is that the toilet paper is delicate and easily tears when used by a child, resulting in the child's hand being contaminated with fecal matter.

Another problem encountered by children when attempting to use conventional toilet paper relates to dispensing the proper amount of toilet paper from the roll. If the child does not dispense a sufficient amount of toilet paper, then that child is likely to end up with a soiled hand. If the child dispenses too much toilet paper, then the child may have difficulty manipulating the toilet paper to effectively wipe the desired area. The use of too much toilet paper is also wasteful and more likely to result in a clogged toilet. Yet another issue faced by children during toilet training is perfecting the proper wiping motion. Learning to properly wipe oneself requires skill and takes time and practice.

As a result of the difficulties present in the toilet training of toddlers the background art reveals a number of attempts to provide solutions to the various problems associated with toilet training. A number of those attempts are directed to providing various toilet paper configurations adapted to protect the user's fingers. For example, U.S. Pat. No. 3,638,789, issued to Tuszewski, discloses a disposable, finger-protecting cleansing mitt for cleaning matter without contaminating one's fingers or hands while being disposable in a conventional flush toilet. U.S. Pat. No. 5,542,566, issued to Glaug, discloses dispensing of flushably disposable child wipe mitts from a container for use in toilet training. U.S. Pat. No. 6,146,365, issued to Nguyen, discloses hygienic gloves formed into a roll of toilet paper. While the above referenced apparatus are generally suitable for the limited applications for which they are intended, they have not achieved widespread commercial acceptance and use due to a number of significant limitations and disadvantages. Accordingly, there exists a need for advancements in the art of toilet training apparatus.

The art described in this section is not intended to constitute an admission that any patent, publication or other information referred to herein is "prior art" with respect to this invention, unless specifically designated as such. In addition, this section should not be construed to mean that a search has been made or that no other pertinent information as defined in 37 C.F.R. § 1.56 (a) exists.

BRIEF SUMMARY OF THE INVENTION

The present invention overcomes the limitations and disadvantages present in the art by providing a flushable toilet paper wipe mitt for use in toilet training children. A toilet paper wipe mitt in accordance with the present invention comprises a generally U-shaped pocket or pouch structure sized to receive the hand of a child. The wipe mitt is formed of soft, pliant, and absorbent material, such as the material used to form conventional toilet paper. A wipe mitt in accordance with the present invention includes an open end, a closed end, opposing first and second sides, and a peripheral edge connecting the first and second sides. The first and second opposing sides are formed of one or more layers and are connected along a common peripheral edge to form a hand-receiving pocket having a hand opening. Each of the first and second sides further include a tab projecting from the open end and a pair of perforation lines extending from the tab toward the closed end. The tab and perforation lines function as frangible tear lines to allow the user to peel back a generally V-shaped portion of one side to facilitate easy removal and disposal of the mitt from the user's hand. The toilet paper wipe mitt provides young children with an easy to use, disposable, sanitary toilet training tool that assists children in learning to properly and thoroughly clean themselves without soiling their hand after using the toilet.

Accordingly, it is an object of the present invention to provide advancements in the field of sanitary tools.

It is another object of the present invention to provide a sanitary wipe mitt for use in potty training children.

Yet another object of the present invention involves providing a sanitary wipe mitt that is flushable.

Still another object of the present invention is to provide a sanitary wipe mitt that is easily removable.

In accordance with these and other objects, which will become apparent hereinafter, the instant invention will now be described with particular reference to the accompanying drawings.

DETAILED DESCRIPTION OF THE INVENTION

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

In describing this invention, the word "connected" is used. By "connected" is meant that the article or structure referred to is joined, either directly, or indirectly, to another article or structure. By "indirectly joined" is meant that there may be an intervening article or structure imposed between the two articles which are "connected". "Directly joined" means that the two articles or structures are in contact with one another or are essentially continuous with one another. By adjacent to a structure is meant that the location is near the identified structure.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
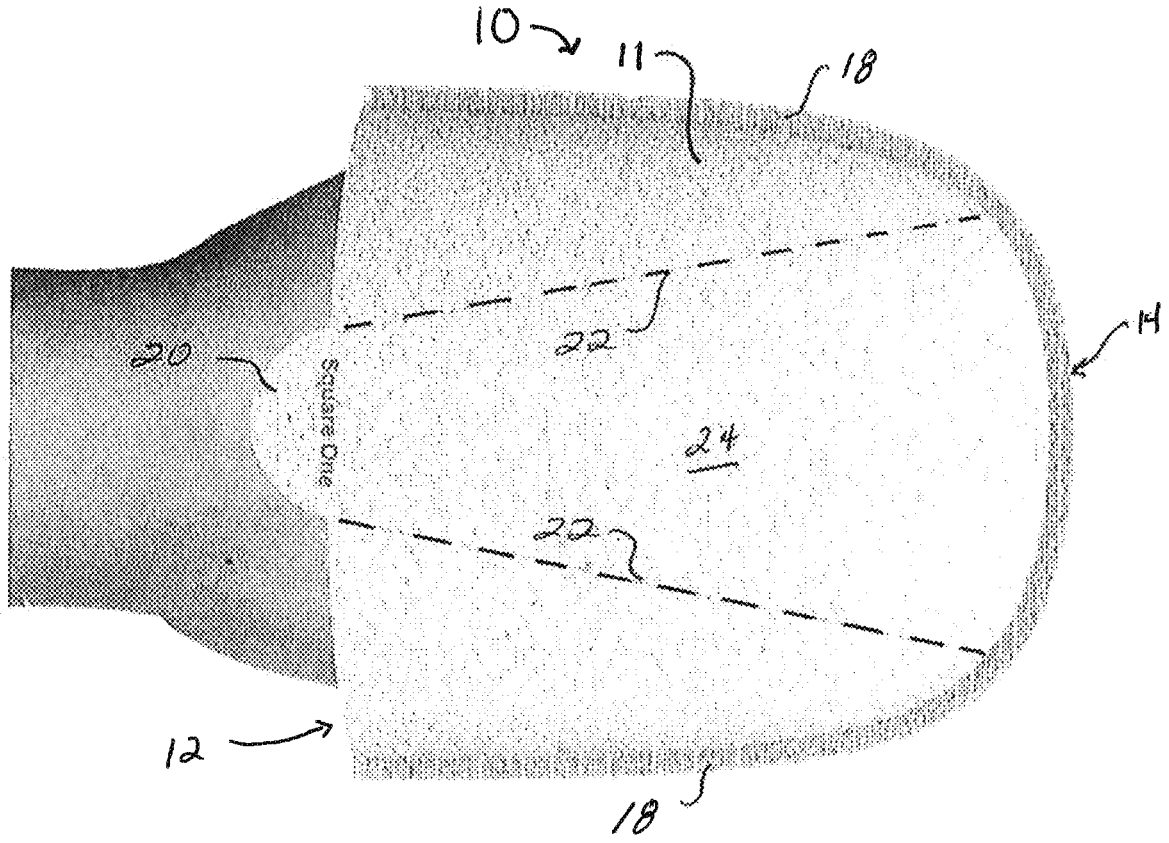
FIG. 1 is a top view illustration of a sanitary wipe mitt disposed on a user's hand in accordance with the present invention.
Figure 2:
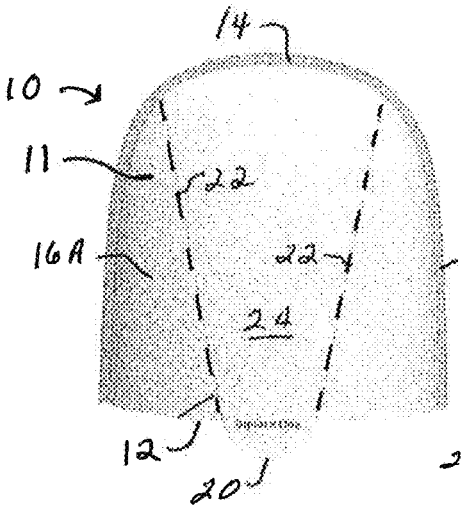
FIG. 2 is first side view of the sanitary wipe mitt.
Figure 3:
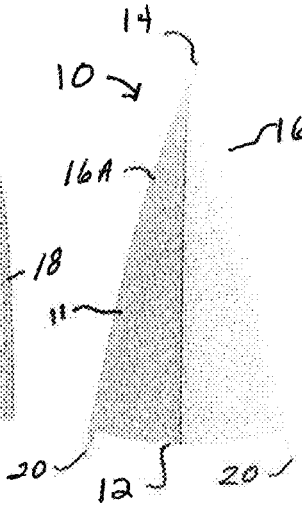
FIG. 3 is a side view of the sanitary wipe mitt.
Figure 4:
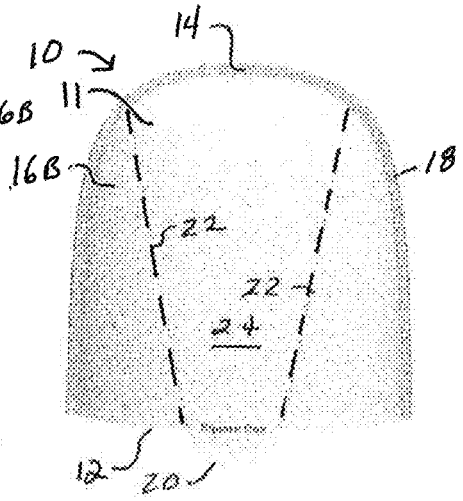
FIG. 4 is an opposing second side view thereof.
Figure 5:
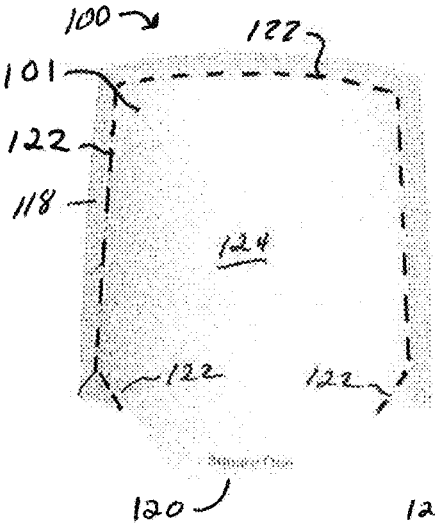
FIG. 5 is a first side view of an alternate embodiment wipe mitt in accordance with the present invention.
Figure 6:
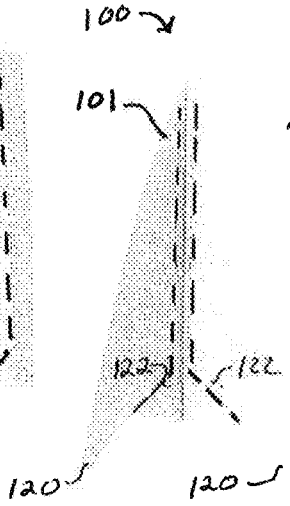
FIG. 6 is a side view thereof.
Figure 7:
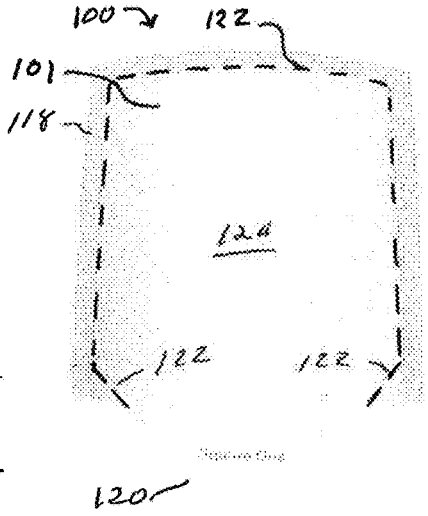
FIG. 7 is an opposing second side view thereof.

Turning now to the drawings, FIGS. 1-4 illustrate a first embodiment of a sanitary wipe mitt in accordance with the present invention, and FIGS. 5-7 depict an alternate embodiment thereof. With reference to FIGS. 1-4, a sanitary wipe mitt, generally referenced as 10, comprises a flushable toilet paper wipe mitt for use in toilet training children. Sanitary wipe mitt 10 comprises a main body formed as pocket or pouch structure sized to receive the hand of a child therein whereby the child can wipe himself/herself after going to the bathroom without soiling his/her hand. In a preferred embodiment, sanitary wipe mitt 10 is sized to completely cover the user's hand, extending down to the wrist area. Wipe mitt 10 is preferably formed of soft, pliant, and absorbent material, such as the material used to form conventional toilet paper, however, any flushable material is considered within the scope of the present invention. It is important that wipe mitt 10 be formed of a material that degrades in water so that the wipe mitt is flushable. In a preferred embodiment, sanitary wipe mitt has a length of approximately 6-inches, and a width of approximately 4-inches. It should be noted, however, that any suitable length and width dimensions are considered within the scope of the present invention. For example, while the present invention is suitable for use by a child, it should be appreciated that the mitt may be scaled to dimensions suitable for use by adults.

Sanitary wipe mitt 10 in accordance with the present invention includes a main body 11 forming a generally U-shaped pocket structure having an open end 12, a closed end 14, opposing first and second sides, referenced as 16A and 16B, and a peripheral edge 18 connecting the first and second sides. The first and second opposing sides are formed of one or more layers and are connected along common peripheral edge 18 to form a hand-receiving pocket defining a hand opening at open end 12. Common peripheral edge 18 forms a seam that connects the corresponding peripheral edges of first and second sides 16A and 16B, and may be formed by crimping, sonic welding, adhesive connection, or any other suitable means of connection. Peripheral edge 18 forms a reinforced seam that is preferably more tear resistant than the remaining mitt structure, particularly the sheets forming first and second sides 16A and 16B. First and second sides 16A and 16B are preferably identical in shape and structure thereby eliminating the need for the user to determine how the sanitary wipe mitt should be worn. Each of the first and second sides 16A and 16B further include a tab 20 projecting from the open end 12 of wipe mitt 10. Each tab 20 extends to a pair of perforation lines, referenced as 22, extending from tab 20 toward the closed end 14 of sanitary wipe mitt 10. Perforation lines 22 function as frangible tear lines as more fully discussed herein. Tab 20 and perforation lines 22 define a peel back portion that functions to allow the user to peel back a generally a V-shaped portion of one side, referenced as 24, to facilitate easy removal and disposal of sanitary wipe mitt 10 from the user's hand. As should be apparent, by peeling back the V-shaped portion of the wipe mitt an opening is formed that allows the user to simply slip his/her hand therefrom while touching only the unsoiled tab 20 to allow for easy disposal. It is thus considered important that peripheral seam 18 functions as a tear/rip stop to prevent separation of the generally V-shaped portion 24 from mitt 10 as tab 20 is pulled. As should be apparent, with this configuration the remaining portion of main body 11 would be left attached to and suspended by the torn V-shaped portion 24 prior to being deposited in the toilet. As noted above, sanitary wipe mitt 10 provides young children with an easy to use, disposable, sanitary toilet training tool that assists children in learning to properly and thoroughly clean themselves without soiling their hand after using the toilet.

FIGS. 5-7 illustrate an alternate embodiment sanitary wipe mitt, generally referenced as 100. Alternate embodiment wipe mitt 100, shares many of the same structural features of sanitary wipe mitt 10. Alternate embodiment wipe mitt 100 includes a main body 101 that differs from the corresponding main body 11 in mitt wipe embodiment 10 in that it defines a less-rounded/more angular or square shape.

In addition, alternate embodiment wipe mitt 100, includes a wider tab 120 than that found on sanitary wipe mitt 10. Furthermore, wipe mitt 100 includes a significantly different perforation line 122 configuration. More particularly, as best seen in FIGS. 5 and 7, perforation lines 122 that extend completely along the inner side of lateral edge 118 thereby forming a closed loop that results in a larger peel back section, referenced as 124, that may become fully detached from the remaining portion of main body 101 upon application of a sufficiently extensive pull. Accordingly, upon pulling on tab 120 while holding sanitary mitt wipe 10 over a toilet, the removal of peel back section 124 can result in the remaining portion of the soiled main body 101 to simply drop into the toilet. Notwithstanding the above-referenced distinctions, alternate embodiment sanitary wipe mitt 100, is functions similar to embodiment 10 discussed herein above.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A sanitary wipe mitt comprising:

a main body forming a pocket having an open end and a closed end;

said main body fabricated from a flushable material;

said main body including first and second sides connected by a tear-resistant peripheral edge;

each of said first and second sides including a pair of perforation lines extending from the open end of said main body;

each of said first and second sides including a tab disposed between said perforation lines and projecting from the open end of said main body;

whereby said tabs and perforation lines function to allow peeling away of a portion of one of said first and second sides disposed between said perforation lines by pulling the corresponding tab to facilitate easy removal and disposal of the mitt.

2. The sanitary wipe mitt according to claim 1 wherein said perforation lines extend from said open end in a diverging manner.

3. The sanitary wipe mitt according to claim 1 wherein said perforation lines extend substantially toward said closed end.

4. The sanitary wipe mitt according to claim 1 wherein said perforation lines extend from said open end to said peripheral edge.

5. The sanitary wipe according to claim 1 wherein said perforation lines extend substantially adjacent to the inner side of said peripheral edge forming a closed loop.

6. A sanitary wipe mitt that receives a user's hand to aid in wiping the user after using a bathroom toilet, said sanitary wipe mitt comprising:

a main body defining a pocket having an open end and a closed end, said open end sized for receiving the user's hand therein;

said main body fabricated from an absorbent flushable material;

said main body including first and second sides connected by a tear resistant peripheral edge;

each of said first and second sides including a pair of linear perforation lines extending from the open end of said main body and disposed in inwardly spaced relation relative to said peripheral edge;

each of said first and second sides including a tab projecting from the open end of said main body and disposed between said perforation lines;

said tabs and said perforation lines function to allow peeling away of a portion of one of said first and second sides disposed between said perforation lines by pulling the corresponding tab to facilitate easy removal and disposal of the mitt.

7. The sanitary wipe mitt according to claim 6 wherein said perforation lines extend from said open end in a diverging manner.

8. The sanitary wipe mitt according to claim 6 wherein said perforation lines extend substantially toward said closed end.

9. The sanitary wipe mitt according to claim 6 wherein said perforation lines extend from said open end to said peripheral edge.

10. The sanitary wipe according to claim 6 wherein said perforation lines extend substantially adjacent to the inner side of said peripheral edge forming a closed loop.

* * * * *